United States Patent [19]

Miller, Jr.

[11] 4,160,681

[45] Jul. 10, 1979

[54] SILICON STEEL AND PROCESSING THEREFORE

[75] Inventor: Clarence L. Miller, Jr., Pittsburgh, Pa.

[73] Assignee: Allegheny Ludlum Industries, Inc., Pittsburgh, Pa.

[21] Appl. No.: 864,363

[22] Filed: Dec. 27, 1977

[51] Int. Cl.[2] ..... H01F 1/04

[52] U.S. Cl. ..... 148/111; 148/31.55; 148/113

[58] Field of Search ..... 148/27, 31.5, 31.55, 148/111, 112, 113; 427/127

[56] References Cited

U.S. PATENT DOCUMENTS

| | | | |
|---|---|---|---|
| 3,054,732 | 9/1962 | McQuade | 148/31.5 |
| 3,522,108 | 7/1970 | Yamamoto et al. | 148/113 |
| 3,676,227 | 7/1972 | Matsumoto et al. | 148/113 |
| 3,700,506 | 10/1972 | Tanaka et al. | 148/111 |
| 4,030,950 | 6/1977 | Shilling | 148/112 |
| 4,054,471 | 10/1977 | Datta | 148/112 |

*Primary Examiner*—L. Dewayne Rutledge
*Assistant Examiner*—John P. Sheehan
*Attorney, Agent, or Firm*—Vincent G. Gioia; Robert F. Dropkin

[57] ABSTRACT

A process for producing electromagnetic silicon steel having a cube-on-edge orientation. The steel has a permeability of at least 1870 ($G/O_e$) at 10 oersteds and a core loss of no more than 0.720 watts per pound at 17 kilogauss - 60 Hz. The process includes the steps of: preparing a melt of silicon steel containing from 0.02 to 0.06% carbon, from 0.0006 to 0.0080% boron, up to 0.0100% nitrogen, no more than 0.008% aluminum and from 2.5 to 4.0% silicon; casting said steel; hot rolling said steel; cold rolling said steel; decarburizing said steel; applying a refractory oxide coating containing both boron and manganese sulfate; and final texture annealing said steel.

14 Claims, No Drawings

SILICON STEEL AND PROCESSING THEREFORE

The present invention relates to an improvement in the manufacture of grain-oriented silicon steels.

U.S. patent application Ser. No. 696,967, filed June 17, 1976, now U.S. Pat. No. 4,102,713 teaches a process wherein manganese dioxide is incorporated within a boron-bearing base coating for application to a boron-bearing steel. Oxygen in the manganese dioxide contributes to the formation of a high quality base coating on boron-bearing steels which receive a low dew point final normalize.

As a certain amount of oxygen must be present in the scale of silicon steel to render the surface susceptible to formation of a high quality base coating; a means of adding oxygen to the scale of boron-bearing steels was sought out. The scale of boron-bearing silicon steels is low in oxygen, as these steels receive a low dew point final normalize. One such means of adding oxygen is disclosed in Ser. No. 696,967. Disclosed therein is a base coating containing manganese dioxide. Oxygen is added to the scale through the inclusion of manganese dioxide in the base coating. Manganese dioxide is, however, a dense insoluble compound; and as a result thereof, difficult to suspend.

The present invention provides an alternative for manganese dioxide. Manganese sulfate is substituted for all or part of the manganese dioxide of Ser. No. 696,967. Manganese sulfate supplies oxygen to the scale as does manganese dioxide. At the same time, it is soluble within the base coating of the subject invention.

A disclosure of a sulfate bearing coating is found in U.S. Pat. No. 3,932,201. The coating described therein is, however, different from that of the subject invention. Said coating contains magnesium sulfate and zinc permanganate. The coating of the subject invention is devoid of these additions. The coating of the subject invention is dependent upon the inclusion of manganese sulfate and boron.

It is accordingly an object of the present invention to provide an improvement in the manufacture of grain-oriented silicon steel.

In accordance with the present invention a melt of silicon steel containing from 0.02 to 0.06% carbon, from 0.0006 to 0.0080% boron, up to 0.0100% nitrogen, no more than 0.008% aluminum and from 2.5 to 4.0% silicon is subjected to the conventional steps of casting, hot rolling, one or more cold rollings, an intermediate normalize when two or more cold rollings are employed, decarburizing, application of a refractory oxide coating and final texture annealing; and to the improvement comprising the steps of coating the surface of the steel with a refractory oxide coating consisting essentially of:

(a) 100 parts, by weight, of at least one substance from the group consisting of oxides, hydroxides, carbonates and boron compounds of magnesium, calcium, aluminum and titanium;

(b) up to 100 parts, by weight, of at least one other substance from the group consisting of boron and compounds thereof, said coating containing at least 0.1%, by weight, of boron;

(c) from 0.5 to 50 parts, by weight, of manganese sulfate;

(d) up to 50 parts, by weight, of oxides less stable than $SiO_2$ at temperatures up to 2150° F., said oxides being of elements other than boron;

(e) up to 40 parts, by weight, of $SiO_2$;

(f) up to 20 parts, by weight, of inhibiting substances or compounds thereof; and (g) up to 10 parts, by weight, of fluxing agents;

and final texture annealing said steel with said coating thereon. For purpose of definition, "one part" equals the total weight of (a) hereinabove, divided by 100. The coating usually contains at least 50% MgO.

Specific processing as to the conventional steps, is not critical and can be in accordance with that specified in any number of publications including U.S. Pat. Nos. 3,873,381, 3,905,842, 3,905,843, 3,957,546 and 4,030,950. Moreover, the term casting is intended to include continuous casting processes. A hot rolled band heat treatment is also includable within the scope of the present invention. It is, however, preferred to cold roll the steel to a thickness no greater than 0.020 inch, without an intermediate anneal between cold rolling passes; from a hot rolled band having a thickness of from about 0.050 to 0.120 inch. Melts consisting essentially of, by weight, 0.02 to 0.06% carbon, 0.015 to 0.15% manganese, 0.01 to 0.05% of material from the group consisting of sulfur and selenium, 0.0006 to 0.0080% boron, up to 0.0100% nitrogen, 2.5 to 4.0% silicon, up to 1.0% copper, no more than 0.0008% aluminum, balance iron, have proven to be particularly adaptable to the subject invention. Boron levels are usually in excess of 0.0008%. Steel produced in accordance with the present invention has a permeability of at least 1870 ($G/O_e$) at 10 oersteds and a core loss of no more than 0.720 watts per pound at 17 kilogauss-60 Hz. Preferably, the steel has a permeability of at least 1890 ($G/O_e$) at 10 oersteds and a core loss of no more than 0.700 watts per pound at 17 kilogauss-60 Hz.

Boron inhibited silicon steels are final normalized (decarburized) at relatively low dew points, as the magnetic properties of said steels improve with the use of low dew points. High dew points are believed to result in a surface condition which has adverse effects on further processing.

The boron-bearing steel of the subject invention is decarburized in a hydrogen-bearing atmosphere having a dew point of from +20° to +110° F. The atmosphere is generally one of hydrogen and nitrogen. The dew point is generally from +40° to +85° F. Temperatures of from 1400° to 1550° F. are particularly desirable as decarburization proceeds most effectively at a temperature of about 1475° F. Time at temperature is usually from ten seconds to ten minutes.

As a general rule, the coating consists essentially of:

(a) 100 parts, by weight, of at least one substance from the group consisting of oxides, hydroxides, carbonates and boron compounds of magnesium, calcium, aluminum and titanium;

(b) up to 100 parts, by weight, of at least one other substance from the group consisting of boron and compounds thereof, said coating containing at least 0.1%, by weight, of boron; and (c) from 0.5 to 50 parts, by weight, of manganese sulfate.

The additional inhibiting substances includable within the coating are usually from the group consisting of sulfur, sulfur compounds, nitrogen compounds, selenium and selenium compounds. The optional fluxing agents include lithium oxide, sodium oxide and other oxides known to those skilled in the art. The optional oxides, which are less stable than $SiO_2$ at temperatures up to 2150° F., include oxides of manganese and iron. An oxide less stable than $SiO_2$ is one having a free energy of formation less negative than $SiO_2$ under the conditions encountered during a high temperature anneal.

The coating of the subject invention is dependent upon the presence of manganese sulfate and boron. Manganese sulfate contributes to the formation of a high quality base coating in boron-bearing steels which receive a low dew point final normalize. Boron improves the steel's magnetic properties. Manganese sulfate is present in amounts of from 0.5 to 50 parts, by weight. Preferred levels are from 2 to 30 parts. Boron is present in an amount of at least 0.1%, by weight. Preferred levels are at least 0.2%. Typical sources of boron are boric acid, fused boric acid ($B_2O_3$), ammonium pentaborate and sodium borate.

The specific mode of applying the coating of the subject invention is not critical thereto. It is just as much within the scope of the subject invention to mix the coating with water and apply it as a slurry, as it is to apply it electrolytically. Likewise, the constituents which make up the coating can be applied together or as individual layers.

Also includable as part of the subject invention is the steel in its primary recrystallized state with the coating of the subject invention adhered thereto. The primary recrystallized steel has a thickness no greater than 0.020 inch and is, in accordance with the present invention, suitable for processing into grain oriented silicon steel having a permeability of at least 1870 ($G/O_e$) at 10 oersteds and a core loss of no more than 0.720 watts per pound at 17 kilogauss-60 Hz. Primary recrystallization takes place during the final normalize.

The following examples are illustrative of several aspects of the invention.

Three heats (Heats A, B and C) of silicon steel were cast and processed into silicon steel having a cube-on-edge orientation. The chemistry for each of the heats appears hereinbelow in Table I.

TABLE I.

| Heat | C | Mn | S | B | N | Si | Cu | Al | Fe |
|---|---|---|---|---|---|---|---|---|---|
| | Composition (Wt. %) | | | | | | | | |
| A. | 0.031 | 0.032 | 0.02 | 0.0011 | 0.0047 | 3.15 | 0.32 | 0.004 | Bal. |
| B. | 0.032 | 0.036 | 0.02 | 0.0013 | 0.0043 | 3.15 | 0.35 | 0.004 | Bal. |
| C. | 0.030 | 0.035 | 0.02 | 0.0013 | 0.0046 | 3.15 | 0.31 | 0.004 | Bal. |

Processing for the heats involved soaking at an elevated temperature for several hours, hot rolling to a nominal gage of 0.080 inch, hot roll band normalizing at a temperature of approximately 1740° F., cold rolling to final gage, decarburizing in an 80 $N_2$/20 $H_2$ atmosphere at a dew point of approximately 50° F., coating as described hereinbelow, and final texture annealing at a maximum temperature of 2150° F. in hydrogen.

Nine coating mixes were prepared. Each coating mix was applied to one sample from heat heat. The makeup of the coating mixes appears hereinbelow in Table II.

TABLE II.

| Mix | MgO (Parts, by Wt.) | $H_3BO_3$ (Parts, by Wt.) | $MnSO_4 \times H_2O$ (Parts, by Wt.) |
|---|---|---|---|
| 1. | 100 | 0 | 0 |
| 2. | 100 | 0 | 1.94 |
| 3. | 100 | 4.57 (0.8% B) | 1.94 |
| 4. | 100 | 4.57 | 3.89 |
| 5. | 100 | 4.57 | 5.83 |
| 6. | 100 | 4.57 | 7.78 |
| 7. | 100 | 4.57 | 9.72 |
| 8. | 100 | 4.57 | 19.44 |
| 9. | 100 | 4.57 | 29.16 |

Franklin values for the coated samples of Heat A (A-1 through A-9) were determined at 900 psi. A perfect insulator has a Franklin value of 0, whereas a perfect conductor has a Franklin value of 1 ampere. The results are reproduced hereinbelow in Table III.

TABLE III.

| Mix | Sample | Franklin Value |
|---|---|---|
| 1. | A-1 | 0.92 |
| 2. | A-2 | 0.87 |
| 3. | A-3 | 0.86 |
| 4. | A-4 | 0.79 |
| 5. | A-5 | 0.81 |
| 6. | A-6 | 0.82 |
| 7. | A-7 | 0.85 |
| 8. | A-8 | 0.84 |
| 9. | A-9 | 0.79 |

Note how the Franklin value decreased from a value of 0.92 to values as low as 0.79, when manganese sulfate is added to the coating. Sample A-1 was coated with pure magnesia and had a Franklin value of 0.92. A lower Franklin value, 0.87, is recorded for Sample A-2. Sample A-2 differs from A-1 in that 1.94 parts, by wt., of manganese sulfate, was added to the water, for every 100 parts, by wt., of magnesia. Further decreases in Franklin values are noted for Samples A-4 through A-9, which had even more manganese sulfate added thereto. Manganese sulfate was found to be beneficial to the insulating quality of the coating.

Samples from each of the heats were tested for permeability and core loss. The results of the tests appear hereinbelow in Table IV.

TABLE IV.

| Mix | Heat A. Perm. (at 10 $O_e$) | Heat A. Core Loss (WPP at 17KB) | Heat B. Perm. (at 10 $O_e$) | Heat B. Core Loss (WPP at 17KB) | Heat C. Perm. (at 10 $O_e$) | Heat C. Core Loss (WPP at 17KB) |
|---|---|---|---|---|---|---|
| 1. | 1889 | 0.729 | 1815 | 0.781 | 1887 | 0.739 |
| 2. | 1888 | 0.727 | 1743 | 0.905 | 1878 | 0.733 |
| 3. | 1916 | 0.670 | 1908 | 0.677 | 1920 | 0.672 |
| 4. | 1914 | 0.683 | 1896 | 0.665 | 1924 | 0.669 |
| 5. | 1915 | 0.670 | 1898 | 0.664 | 1921 | 0.664 |
| 6. | 1918 | 0.660 | 1898 | 0.659 | 1932 | 0.651 |
| 7. | 1926 | 0.669 | 1914 | 0.666 | 1924 | 0.667 |

TABLE IV.-continued

| | Heat | | | | | |
|---|---|---|---|---|---|---|
| | A. | | B. | | C. | |
| Mix | Perm. (at 10 $O_e$) | Core Loss (WPP at 17KB) | Perm. (at 10 $O_e$) | Core Loss (WPP at 17KB) | Perm. (at 10 $O_e$) | Core Loss (WPP at 17KB) |
| 8. | 1915 | 0.676 | 1912 | 0.657 | 1925 | 0.669 |
| 9. | 1914 | 0.679 | 1907 | 0.670 | 1911 | 0.671 |

The benefit of boron in the coating is clearly evident from Table IV. Improvement in both permeability and core loss can be attributed thereto. The permeabilities for Samples A-2, B-2 and C-2, to which boron was not applied, were 1888, 1743 and 1878; whereas the respective values for Samples A-3, B-3 and C-3, to which boron was applied, were 1916, 1908 and 1920. The core losses for Samples A-2, B-2 and C-2, to which boron was not applied, were 0.727, 0.905 and 0.733; whereas the respective values for Samples A-3, B-3 and C-3, to which boron was applied, were 0.670, 0.677 and 0.672.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for producing electromagnetic silicon steel having a cube-on-edge orientation, which process includes the steps of: preparing a melt of silicon steel containing from 0.02 to 0.06% carbon, from 0.0006 to 0.0080% boron, up to 0.0100% nitrogen, no more than 0.008% aluminum and from 2.5 to 4.0% silicon; casting said steel; hot rolling said steel; cold rolling said steel; decarburizing said steel; applying a refractory oxide coating to said steel; and final texture annealing said steel; the improvement comprising the steps of coating the surface of said steel with a refractory oxide coating consisting essentially of:

(a) 100 parts, by weight, of at least one substance from the group consisting of oxides, hydroxides, carbonates and boron compounds of magnesium, calcium, aluminum and titanium;

(b) up to 100 parts, by weight of at least one other substance from the group consisting of boron and compounds thereof, said coating containing at least 0.1%, by weight, of boron;

(c) from 0.5 to 50 parts, by weight, of manganese sulfate;

(d) up to 50 parts, by weight, of oxides less stable than $SiO_2$ at temperatures up to 2150° F., said oxides being of elements other than boron;

(e) up to 40 parts, by weight, of $SiO_2$;

(f) up to 20 parts, by weight, of inhibiting substances; and (g) up to 10 parts, by weight, of fluxing agent;

and final texture annealing said steel with said coating thereon; said steel having a permeability of at least 1870 ($G/O_e$) at 10 oersteds and a core loss of no more than 0.720 watts per pound at 17 kilogauss-60 Hz.

2. The process according to claim 1, wherein said melt has at least 0.0008% boron.

3. The improvement according to claim 2, wherein said coating has at least 0.2% boron.

4. The improvement according to claim 2, wherein said coating has from 2 to 30 parts manganese sulfate.

5. The process according to claim 2, wherein said hot rolled steel has a thickness of from 0.050 to about 0.120 inch and wherein said hot rolled steel is cold rolled to a thickness no greater than 0.020 inch without an intermediate anneal between cold rolling passes.

6. The process according to claim 2, wherein said steel is decarburized in a hydrogen-bearing atmosphere having a dew point of from +20° to +110° F.

7. The process according to claim 6, wherein said dew point is from +40° to +85° F.

8. The process according to claim 7, wherein said hydrogen-bearing atmosphere consists essentially of hydrogen and nitrogen.

9. The process according to claim 1, wherein said melt consists essentially of, by weight, 0.02 to 0.06% carbon, 0.015 to 0.15% manganese, 0.01 to 0.05% of material from the group consisting of sulfur and selenium, 0.0006 to 0.0080% boron, up to 0.0100% nitrogen, 2.5 to 4.0% silicon, up to 1.0% copper, no more than 0.008% aluminum, balance iron.

10. The process according to claim 9, wherein said melt has at least 0.0008% boron.

11. The process according to claim 1, wherein said electromagnetic silicon steel has a permeability of at least 1890 ($G/O_e$) at 10 oersteds and a core loss of no more than 0.700 watts per pound at 17 kilogauss-60 Hz.

12. A cube-on-edge oriented silicon steel having a permeability of at least 1870 ($G/O_e$) at 10 oersteds and a core loss of no more than 0.720 watts per pound at 17 kilogauss-60 Hz; and made in accordance with the process of claim 2.

13. Primary recrystallized steel from a melt consisting essentially of, by weight, 0.02 to 0.06% carbon, 0.015 to 0.15% manganese, 0.01 to 0.05% of material from the group consisting of sulfur and selenium, 0.0006 to 0.0080% boron, up to 0.0100% nitrogen, 2.5 to 4.0% silicon, up to 1.0% copper, no more than 0.008% aluminum, balance iron; and having adhered thereto, a coating consisting essentially of:

(a) 100 parts, by weight, of at least one substance from the group consisting of oxides, hydroxides, carbonates and boron compounds of magnesium, calcium, aluminum and titanium;

(b) up to 100 parts, by weight, of at least one other substance from the group consisting of boron and compounds thereof, said coating containing at least 0.1%, by weight, of boron; and (c) from 0.5 to 50 parts, by weight, of manganese sulfate.

14. Primary recrystallized steel according to claim 13, having a least 0.0008% boron.

* * * * *